US006780285B2

(12) United States Patent
Leinonen et al.

(10) Patent No.: US 6,780,285 B2
(45) Date of Patent: Aug. 24, 2004

(54) LOADING DEVICE INCLUDING A LOADING MEMBER FOR SUPPORTING AND DEWATERING A WEB FORMING WIRE

(75) Inventors: Antti Leinonen, Laukaa (FI); Seppo Kiviranta, Jyväskylä (FI); Aimo Närväinen, Palokka (FI); Jukka Pihlajasaari, Vaajakoski (FI); Hannu Villgrén, Jyväskylä (FI); Kari Lamminmäki, Jyväskylä (FI); Atte Marttinen, Säynätsalo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/740,176

(22) Filed: Dec. 18, 2000

(65) Prior Publication Data

US 2001/0004006 A1 Jun. 21, 2001

(30) Foreign Application Priority Data

Dec. 16, 1999 (FI) ..... 992699

(51) Int. Cl.[7] ..... D21F 1/00
(52) U.S. Cl. ..... 162/352
(58) Field of Search ..... 162/352, 374, 162/301

(56) References Cited

U.S. PATENT DOCUMENTS 2,170,109 A * 8/1939 Berry ..... 162/352
3,201,308 A 8/1965 Goddard ..... 162/352
3,535,204 A * 10/1970 Trixa ..... 167/352
5,078,835 A 1/1992 Schiel et al. ..... 162/352
5,169,500 A * 12/1992 Mejdell ..... 162/352
5,262,010 A 11/1993 Bubik et al. ..... 162/352
5,387,320 A 2/1995 Jaakkola ..... 162/301
5,507,918 A 4/1996 Polifke et al. ..... 162/301
5,660,689 A * 8/1997 Bartelmuss et al. ..... 162/352
5,695,613 A 12/1997 Hentilä et al. ..... 162/301
6,183,602 B1 * 2/2001 Iwata et al. ..... 162/352

* cited by examiner

*Primary Examiner*—Peter Chin
(74) *Attorney, Agent, or Firm*—Steinberg & Raskin, P.C.

(57) ABSTRACT

The invention concerns a loading device for the dewatering a web-forming wire, which supports and/or loads the wire of a paper machine and scrapes water from the wire surface. The loading device is loaded by a pressure medium and includes a movable loading member and a fixed base member. The loading member includes a longitudinal groove which extends the length of the loading member and the base member includes a slide rail adapted to be received in the longitudinal groove for supporting the loading member. In order to eliminate jamming phenomenon of the loading member, the loading member is supported evenly in its position in a cross machine direction and it is adapted to move towards the wire and away from the wire with aid of rollers arranged between the slide rail and the internal walls of the loading member which define the longitudinal groove.

9 Claims, 3 Drawing Sheets

LOADING DEVICE INCLUDING A LOADING MEMBER FOR SUPPORTING AND DEWATERING A WEB FORMING WIRE

FIELD OF THE INVENTION

The present invention relates to the web-forming section, that is, the former section of a paper machine, board machine, tissue machine or the like. More specifically, the invention concerns a loading device for supporting and dewatering a web-forming wire of a paper machine or the like.

BACKGROUND OF THE INVENTION

Several different wire supporting and dewatering components are used in the web-forming sections of a paper machine or the like. The main purpose of these components is to generate a compression pressure and pressure pulsation in the fiber layer to be formed, to thereby promote the removal of water from the web to be formed, and at the same time contribute to the formation of the web.

With regard to know arrangements for web-forming components, general reference is made to the applicant's FI patent publication 90 673, which discloses a two-wire web-forming section of a paper machine which includes a carrying wire and a covering wire. The carrying wire and covering wire together define a two-wire forming zone. In this forming zone is fitted a forming unit including a forming table and a dewatering box which generates a vacuum for removing water from the wire. The dewatering box includes a set of spaced ribs upon which the wire travels. During operation an upper one of the wires rests against the ribs and water is removed from the web by the dewatering box through the spaces defined between the rib elements.

Reference is also made to the applicant's patent publication FI 95935 which relates to a rib construction for a draining device in a paper machine. Specifically a rib construction is disclosed in which a loading rib is used to support and/or load a wire in a paper machine to doctor water from the face of the wire or wires. The rib is loaded by means of a pressure medium. Between the rib and its frame part, a pressure space is formed and defined by a flexible belt. The pressure medium is introduced into the pressure space defined by the flexible belt thereby loading the rib against the wire.

Reference is further made to patent publication FI 100543 which relates to a ledge for resiliently supporting a drainage wire of a paper machine. The ledge disclosed includes a head ledge which is structured and arranged across the direction of travel of the wire so the wire can slide over said ledge as the wire travels. The head ledge is rigidly connected to a movable support ledge which also extends across the direction of travel of wire and is guided on a stationary support structure. Between the movable support ledge and the stationary structure there is a resilient push device which can displace the movable support ledge together with the head ledge between a position of rest away from the wire and an operating position in which the head ledge is pressed with a predetermined force against the wire. The stationary structure has several guide arms distributed over the length of the support ledge which are the exclusive means for guiding the movable support ledge. Several guide arms arranged in pairs are provided which grip around the support ledge in the manner of a clamp.

It has been a problem in known state-of-the-art loading devices that jamming of the loading member of the loading device can occur as a result of which more power is needed to make loading member move. As the loading member presses against the wire, the loading member is subjected to a torque as a result of the wire movement, which torque causes the above-mentioned jamming of the loading member. In order to overcome the jamming of the loading member a strong force must be applied to loading device. This problem is harmful to formation of the web, because the loading force placed on the wire via the loading member cannot be accurately controlled. Thus, it is a common problem that the loading member either applies too much pressure or too little pressure to the wire resulting in said web formation problems.

OBJECTS AND SUMMARY OF THE INVENTION

It is an object of the present invention to provide a loading device which overcomes the short comings of the prior art arrangements discussed above.

The present invention is based on the new and inventive idea that in order to prevent the jamming phenomenon of the loading member, a pivoting roller or rollers or balls are arranged between the loading member of the device and the base member of the device, which will prevent occurrence of said jamming problems.

According to one especially advantageous embodiment of the invention, such a roller is fitted to the top end of the base member of the loading device, the periphery said roller being arranged so that it abuts a portion of the loading member so that it can move in an up and down fashion relative to the base member.

According to another advantageous embodiment of the invention, a pin is fitted to the top end of the base member of the loading device and, correspondingly, a ball bushing is arranged within the loading member, whereby the pin will roll along the balls of the ball bushing.

BRIEF DESCRIPTION OF THE DRAWINGS

In the following, the invention will be described in greater detail with reference to the appended drawing, to the details of which, however, the invention is not intended to be limited in any narrow sense. In the patent drawing.

DETAILED DESCRIPTION OF THE INVENTION

Figure 1:
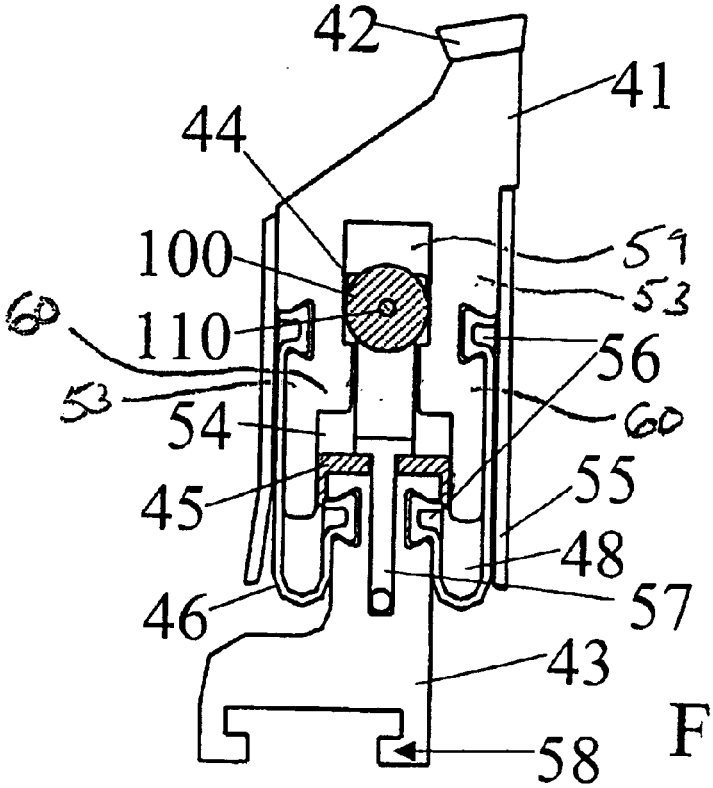
FIG. 1 is a diagrammatic vertical sectional view a first embodiment of the loading device according to the present invention.

In accordance with FIG. 1, in a first embodiment of the invention, the loading device, which extends transversely relative to the direction of movement of the wire, that is, in the cross machine (CD) direction essentially over the entire width of the web forming section. The loading device includes a loading member 41 which extends in the CD direction and a base member 43 which also extends in the CD direction. The base member 43 has an upper portion which defines a slide rail 44. The slide 44 may be formed integrally with base member 43 or it may separately formed and attached to an upper surface of the base member 43.

The loading member 41 includes a lengthwise longitudinal groove 54 formed in a lower face thereof, said longitudinal groove extending in the cross machine direction. The loading device according to the invention is structured and arranged so that loading member 41 is maintained in stable position in cross machine direction but is able to move towards and away from the wire while being supported on slide rail 44 to thereby enable the selective loading and unloading of the wire.

A planar and/or inclined ceramic piece 42 is coupled to the upper part of loading member 41. The ceramic piece 42 is structured and arranged to drag against the wire surface loading the same. The ceramic piece scrapes the lower surface of the wire and in this manner serves to remove water therefrom. The water acts as a lubricated fluid between the ceramic piece 42 and the wire.

The loading device according to the present invention further includes roller means 100 which also extend substantially along the length of the device in the cross machine direction.

As shown in the figures the loading member 41 is substantially U-shaped and includes two substantially parallel arms 53. The parallel arms define an upper internal longitudinal groove 59 and said longitudinal grove 54. Groove 59 and 54 are separated by a shoulder portion 60 of the arms as shown. Internal longitudinal groove 59 is adapted and to receive said roller means 100 such that an internal wall of each of said parallel arms abuts said roller means 100 and acts as a contact surface between said loading element 41 and said roller means.

In the embodiment of the invention shown in FIG. 1, the loading member 41 moves in the up-and-down direction in relation to slide rail 44. In order to maximize easy sliding, rolling is promoted with the aid of roller 100 between body part 43, slide rail 44 and loading member 41. According to the invention, roller 100 is coupled to slide rail 44 of the loading element with the aid of rotating shaft 110.

In the first embodiment of the invention shown in FIG. 1, a single roller 100 arrangement is preferably employed. However, a multiple roller arrangement may also be employed.

To make sure that rolling friction is constantly maintained between roller 100 and the loading member 41, the loading member 41 and base member 43 are structured and arranged so when they are fit together a certain degree of play exists therebetween. As a result of this arrangement when the force caused by the wire is imposed upon the loading member 41, base member 43 does not generate friction force except on a side of roller 100. In this manner the smooth movement of the loading member 41 is insured and the jamming problems associated with prior art arrangements is avoided.

Figure 2:
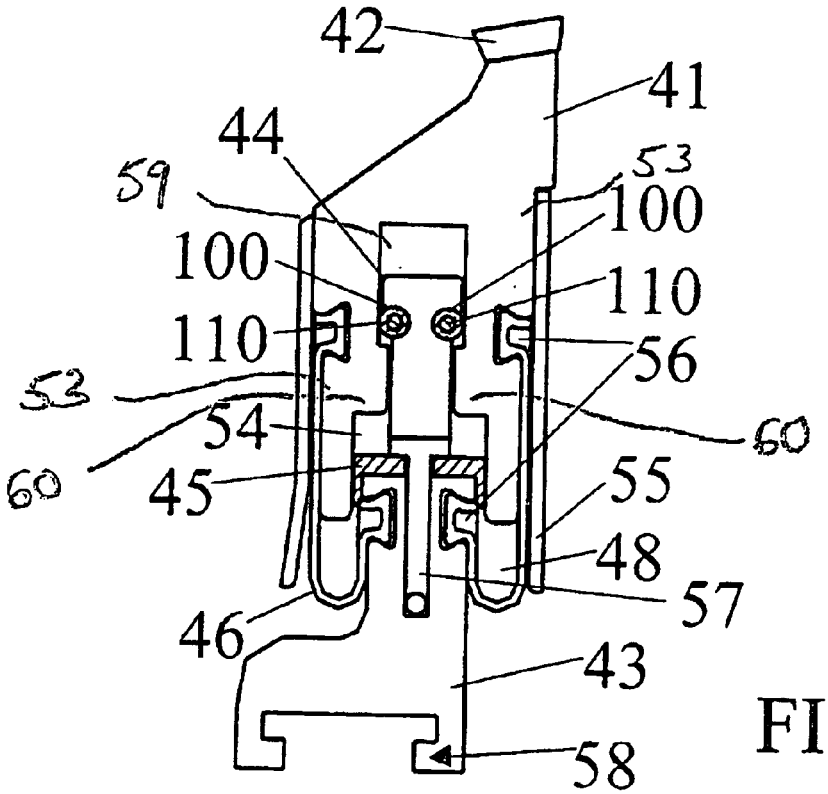
FIG. 2 is a diagrammatic vertical sectional view of a second embodiment of the loading device according to the present invention.

In a second embodiment of the invention, shown in FIG. 2, the loading device extends transversely to the direction of movement of the wire, that is, in the CD direction, essentially over the entire width of the web forming section. The device includes a loading member 41 in the CD direction and a base member 43 also arranged in the CD direction. A top part of the base member forms a slide rail 44. In accordance with the invention, loading member 41, which lengthwise has a longitudinal groove 54, is supported evenly in its position in the CD direction and is adapted to move towards and away from the wire supported by slide rail 44 and by roller means 100, which are installed in the upper surface of slide rail 44 with the aid of rotating shafts 110. The upper side of loading member 41 drags against the wire surface loading the same, whereby the loading member 41 scrapes water to be removed from the web away from the lower surface of the wire.

In the embodiment shown in FIG. 2, loading member 41 is adapted to move in an up-and-down direction in relation to slide rail 44. In order to maximize ease of sliding, rolling is promoted with the aid of rollers 100 arranged between base member 43, slide rail 44 and loading member 41. In accordance with the invention, rollers 100 are coupled to body part 43 with the aid of rotating shafts 110.

In the second embodiment of the invention, rollers 100 are mounted along either side of slide rail 44 as show in FIG. 2. Each roller 100 and their corresponding rotating shafts 110 extend in the CD direction across the width of loading member 41. The rotating shafts 110 are coupled to the slide rail 44 at least at their ends. It is advantageous that over the length of each roller 100 supporting bearings (not shown in FIG. 2) are arranged at selected intervals along the length of the roller. For example roller or slide bearings could be arranged in order to support rollers 100 between their ends. Alternatively, slide rail 44, which typically is an integral part with body part 43, may be provided with several rollers 100 and corresponding mutually spaced indentations (not shown in FIG. 2) which are structured and arranged to receive a corresponding one of said rollers 100. The indentations are arranged so that the roller 100 is exposed towards loading member 41 in the manner shown in FIG. 2.

In the embodiment of the invention shown FIG. 2, each roller 100 has only one stop face, whereby a constant rolling friction is maintained between loading member 41 and rollers 100, and thus their mutual fitting can be made essentially with an absence of play.

Figure 3:
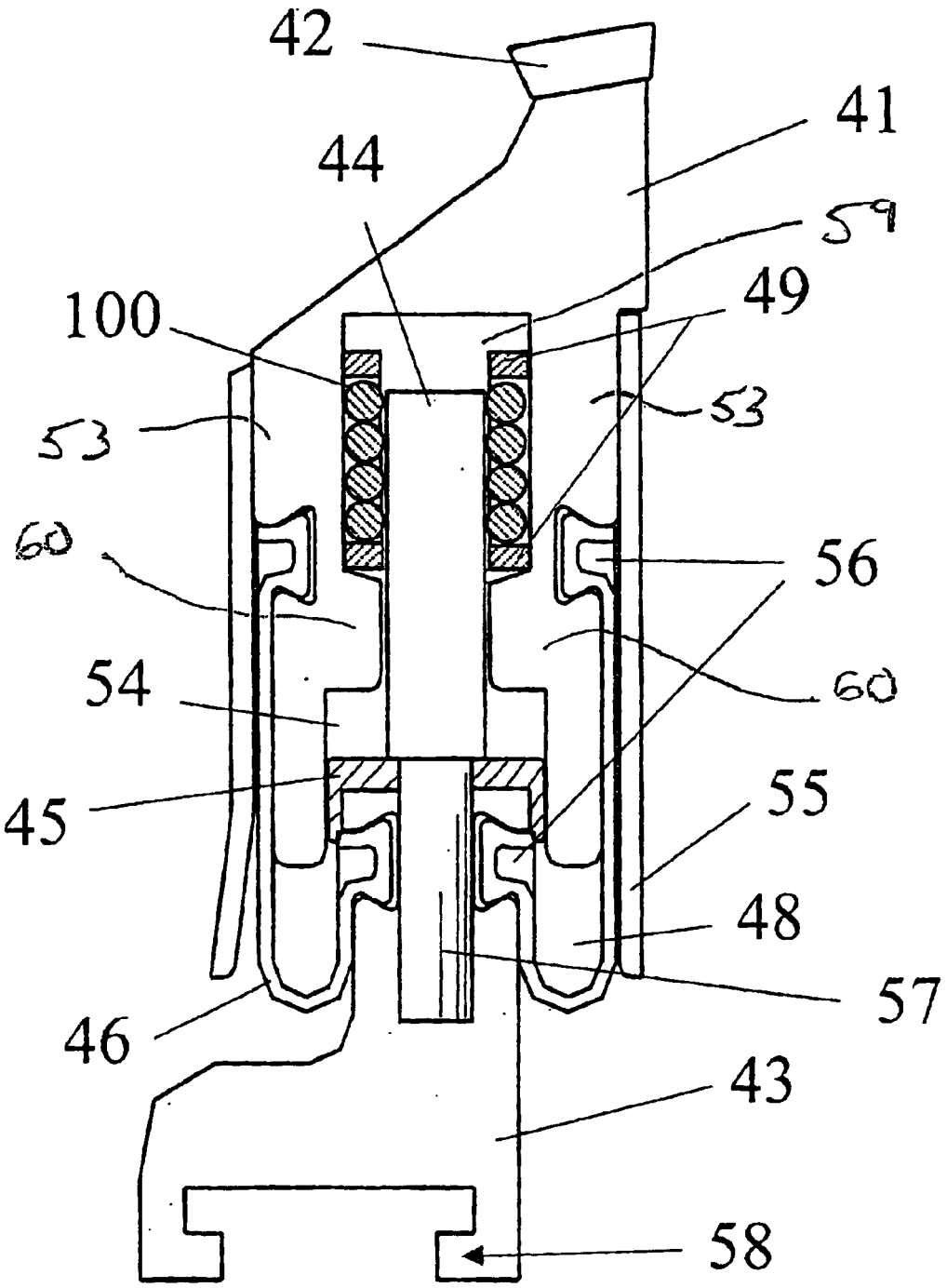
FIG. 3 is a diagrammatic vertical sectional view of a third embodiment of the loading device according to the present invention.
Figure 4:
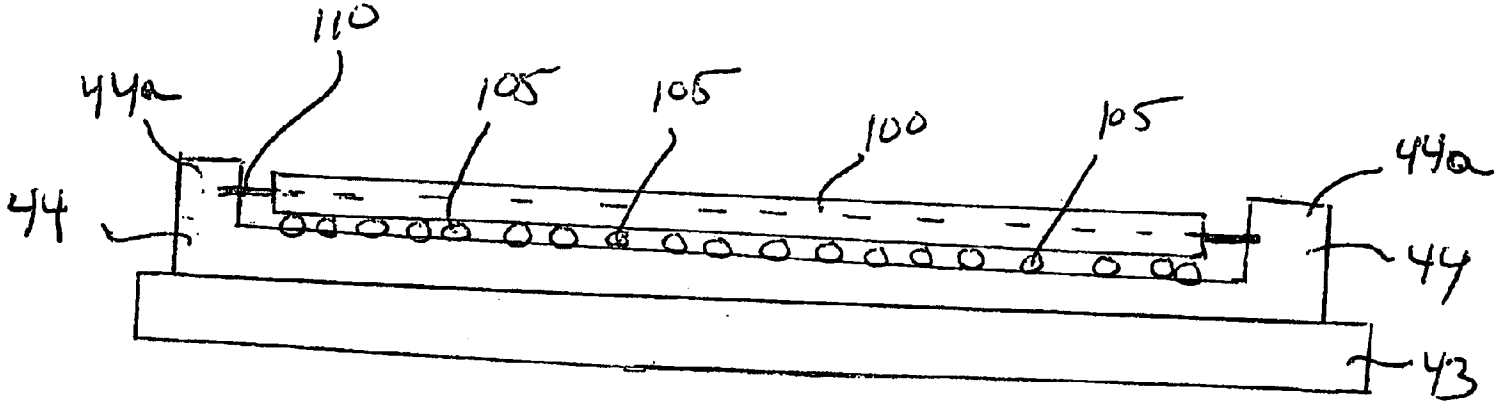
FIG. 4 is a diagrammatic elevational view of the loading device according to the present invention taken in the machine direction showing the base member, slide rail and connecting rod.

Two possible constructions of the roller means 100 discussed above are shown in FIGS. 4 and 5 which depict the loading device according to the present invention in a machine direction. It is noted that the loading member 41 has not been shown in FIGS. 4 and 5 merely to enable the clear viewing of the remaining structural elements of the device. Nonetheless, it is appreciated that loading member 41 is arranged on top of the base member 43 and glide rail 44 as shown in FIGS. 1–3. In one arrangement of the roller means, shown in FIG. 4, a single roller 100 extends substantially across the entire width of the loading device. The roller 100 is coupled at each of its ends to an upright 44*a* of the glide rail 44 by means of rotating shaft 110. Arranged on an upper surface of glide rail 44 are support bearings 105 or the like which are arranged at selected intervals along the length of the roller 100 to thereby assist in supporting said roller 100. The upper surface of glide rail 44 may be provided with grooves or the like which would function as a seat for the support bearings 105.

Figure 5:
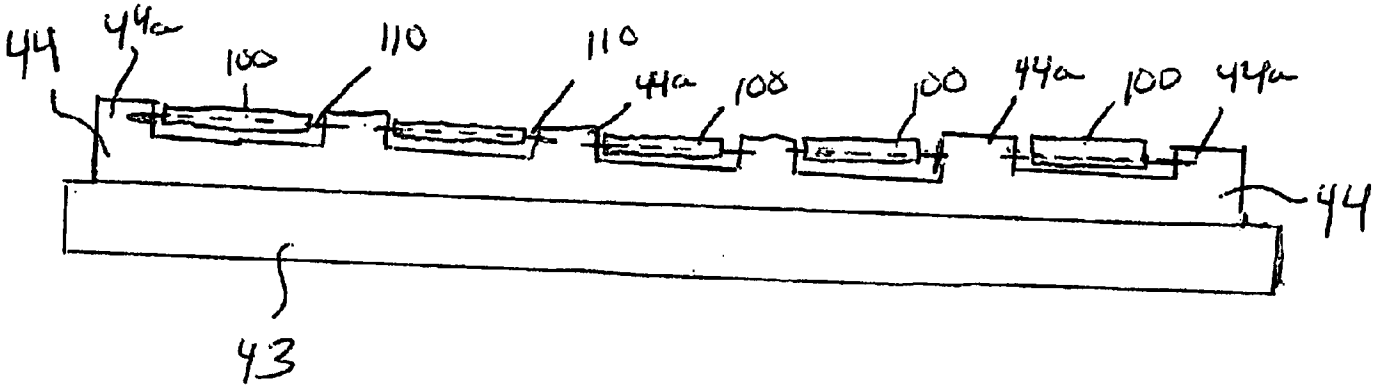
FIG. 5 is a diagrammatic elevational view of the loading device according to the present invention taken in the machine direction showing an alternate arrangement of the base member, slide rail and connecting rod.

In an another arrangement of the roller means, shown in FIG. 5, multiple rollers 100 are arranged at selected intervals in the cross machine direction. In such an arrangement the slide rail 44 is provided with a plurality of spaced uprights 44*a*. A pair of each of the uprights define an indentation, cavity or the like in the slide rail between a respective pair of the upright, the indentation being adapted to receive a roller. Thus, each of the rollers 100 are structured and arranged to fit between two corresponding uprights 44*a* as shown. Each roller 100 coupled to two corresponding uprights by a rotating shaft 110 which is coupled at each of its ends to a corresponding one of the uprights 44*a*. It is also possible that a single rotating shaft 110 could be employed which would pass through all of the uprights 44*a* and rollers and be coupled at each of ends in a manner similar to the arrangement shown in FIG. 5.

Where a plurality of rollers 100 a employed, it is preferable that each one of the rollers being arranged at uniform intervals of 500 mm over the entire width of the device. It is emphasized that the rollers may be of different lengths and that it is possible to implement a roller structure according to the invention with one roller 100 only.

In both embodiments of the invention, as shown in FIGS. 1 and 2, it is advantageous that the individual rollers 100 are made of a material which withstands the pressure impact to which it is subjected and which significantly reduces friction that significantly impedes the movement of loading member 41.

Preferably the loading member 41, base member 43 and slide rail 44 are made of glass fiber and, in addition, a wear-resistant ceramic piece 42 is mounted on the end of lath loading member 41. In performed tests it has proved advantageous at the lower slide surface of body part 43 to mount a friction-reducing slide piece 45, which reduces friction between loading member 41 and base member 43. Slide piece 45 functions to further enable the easy adjustment and movement of loading member 41 relative to the base member 43. Instead of slide part 45 it is also possible to use ball/round bars in order to reduce friction even more between loading member 41 and base member 43.

In another embodiment of the invention, shown in FIG. 3, loading device, which extends transversely to the direction of movement of the wire, that is, in the cross machine direction essentially over the entire width of the web, includes a loading member 41 which is also arranged in the CD direction. The device further includes a base member 43 arranged in the CD direction. A top portion of the base member 43 includes a slide part/parts 44, in relation to which loading member 41 moves towards and away from the wire.

In accordance with the invention, the loading member 41 includes lengthwise a longitudinal groove 54. The loading member 41 is adapted to move in an up and down manner relative to the wire. The loading member is supported by slide part/parts 44 and ball means 100 which are arranged in the manner shown in FIG. 3.

The planar and/or inclined upper portion of loading member 41 drags against the wire surface loading the wire, whereby the loading member 41 functions to remove water from the lower surface of the wire.

In the third embodiment of the invention shown in FIG. 3, loading member 41 moves in an up-and-down direction in relation to slide part 44. To maximize ease of movement, balls 100 are arranged between an internal face of the loading member 41 and an external surface of the slide part 44. According to the invention, balls 100 are mounted to loading member 41 with the aid of ball bushing 49.

In third embodiment of the invention, several balls 100 are mounted in the manner shown in FIG. 3 to form a ball stack. A plurality of these individual ball stacks are arranged in the transverse machine direction across the length of the loading device. Preferably each of the stacks are arranged at a selected distance from one another. For example the distance from stack to another may be between 200 and 280 mm in the transverse machine direction. In this embodiment it is preferable that slide part 44 is defined by a plurality of pins or the like formed in the top part of base member 43 and that the top parts of the slide parts 44 are fitted with some play with relation to the ball bushings 49.

Ball bushings 49 are provided to house each stacks of balls 100, the ball bushings 49 being secured to loading member 41. In this manner the ball bushings 49 and balls 100 therein allow a smooth relative movement between slide part 44 defined by said pins and loading member 41 in the up-and-down direction and at the same time preventing slide part 44 and loading member 41 from jamming. The balls 100 fitted into ball bushing 49 preferably form a bearing, the type of which is e.g. SKF LBBR 12-2LS/HV6.

As was described in the foregoing in connection with the first and second embodiments of application of the invention, it is also possible in this third form of application of the invention when desired to mount a friction-reducing slide piece 45 on the lower slide surface of body part 43, which slide piece reduces friction between 41 and body part 43.

In all of the embodiments discussed above with reference to FIGS. 1–3, a flexible belt 46 extends along each side of the device as shown. Each flexible belt 46 is joined to the lower edge of the loading member 41, and the belt is attached to the a part of body part 43 in such a way that U-shaped loops 48 are formed which extend downwardly as shown. Specifically a first longitudinal edge of belt 46 is attached to loading member 44 and a second longitudinal edge of belt 46 is attached base member 43. The ends of each belt 46 are attached to a groove 56 formed in the loading member 41 and the base member 43. To the exteriors sides of the loading member 41, outside belt 46, are attached shield plates 55 which limit the lateral movement of belt 46. Belt 46 has a thickness of about. 0.1–3 mm, preferably 1–2 mm, and is preferably made of rubber or some other similar flexible material.

Using attaching elements 58, the loading device is attached to the other body of the machine. The loading force of loading member 41 is brought about by generating a loading pressure by introducing a pressure medium, such as air, through channel 57 into the space defined by the flexible belt 46, loading member 41 and base member 43.

The loading pressure is reduced by lowering the pressure of the medium. Upon removal of pressure the loading member 41 will return to its bottom position as a result of gravity thereby unloading the wire. A vacuum may also be used to promote the return of the loading member 41 back to its lower position.

The examples of the invention provided above are not meant to be exclusive. Many other variations of the present invention would be obvious to those skilled in the art, and are contemplated to be within the scope of the present invention.

We claim:

1. A loading device for loading a web forming wire, said loading device comprising:

a fixed base member;

a movable loading member coupled to said base member, said loading member structured and arranged to move in a vertical fashion relative to said base member to thereby apply a loading force to said wire;

at least one flexible belt joined to the loading member and to the base member;

means for introducing a pressure medium into a space defined by said at least one flexible belt, said loading member and said base member below said movable loading member to generate said vertical movement of said loading member;

roller means including at least one roller structured and arranged to support said loading member such that the force generated against said loading member by said wire is directed against a side of said roller whereby jamming of said loading member is prevented; and wherein said at least one roller is coupled to said base member by a rotating shaft to enable the rotation of said roller.

2. The loading device according to claim 1, wherein said base member comprises a slide rail which extends from an upper surface of said base member and wherein said loading member is structured and arranged to receive said slide rail.

3. The loading device according to claim 2, wherein said roller means comprises a single roller which extends substantially across the entire width of the loading device.

4. The loading device according to claim 3, further comprising supporting bearings arranged between said single roller and an upper surface of said slide rail for supporting said single roller and wherein said supporting bearings are arranged at selected intervals along a length of said single roller.

5. The loading device according to claim 2, wherein in said roller means comprises a plurality of rollers arranged at selected intervals in the cross-machine direction and wherein said slide rail has a plurality of indentations, each one of said indentations being structured and arranged for receiving one of said plurality of rollers.

6. The loading device according to claim 2, wherein said roller means comprises at least one roller arranged on each side of said slide rail.

7. The loading device according to claim 1, wherein said roller means comprises a plurality of vertically arranged ball stacks, each one of said balls stacks being arranged at selected locations in a cross-machine direction of said loading device and each one of said plurality of ball stacks being housed in a corresponding bushing attached to said loading member.

8. The loading device according to claim 7, wherein each one of said ball stacks are arranged at intervals of 200 to 280 mm from one another in said cross machine direction.

9. The loading device according to claim 1, further comprising a friction reducing means arranged between the base member and said loading member and wherein said friction reducing means comprises one of a friction reducing slide piece and balls/round bars arranged between said base member and said loading member.

* * * * *